US011162230B2

(12) United States Patent
Thieme et al.

(10) Patent No.: US 11,162,230 B2
(45) Date of Patent: Nov. 2, 2021

(54) CONCRETE TEXTURING MACHINE

(71) Applicant: Wirtgen GmbH, Windhagen (DE)

(72) Inventors: Holger Thieme, Vettelschoss (DE); Martin Lenz, Grossmaischeid (DE); Cyrus Barimani, Konigswinter (DE)

(73) Assignee: Wirtgen GmbH

( * ) Notice: Subject to any disclaimer, the term of this patent is extended or adjusted under 35 U.S.C. 154(b) by 49 days.

(21) Appl. No.: 16/190,225

(22) Filed: Nov. 14, 2018

(65) Prior Publication Data

US 2019/0136464 A1 May 9, 2019

Related U.S. Application Data

(62) Division of application No. 14/690,993, filed on Apr. 20, 2015, now Pat. No. 10,132,046.

(51) Int. Cl.

| | |
|---|---|
| ***E01C 23/16*** | (2006.01) |
| ***E01C 19/00*** | (2006.01) |
| ***E01C 19/43*** | (2006.01) |
| ***E01C 23/03*** | (2006.01) |

(52) U.S. Cl.

CPC ..... *E01C 19/008* (2013.01); *E01C 19/43* (2013.01); *E01C 23/03* (2013.01)

(58) Field of Classification Search

CPC ..... E01C 19/43; E01C 23/02
USPC ..... 404/75, 96
See application file for complete search history.

(56) References Cited

U.S. PATENT DOCUMENTS

| | | | | |
|---|---|---|---|---|
| 2,116,816 | A * | 5/1938 | Winkler | E01C 19/407 404/116 |
| 3,272,099 | A * | 9/1966 | Drake | E01C 19/4873 404/84.2 |
| 3,605,579 | A | 9/1971 | Heltzel | |
| 3,749,504 | A | 7/1973 | Smith | |
| 3,775,018 | A * | 11/1973 | Barton | E01C 19/43 404/93 |

(Continued)

OTHER PUBLICATIONS

Ex. A: "GOMACO TIC-5600" Brochure, 4 pp., 2013.

(Continued)

*Primary Examiner* — Thomas B Will
*Assistant Examiner* — Katherine J Chu
(74) *Attorney, Agent, or Firm* — Lucian Wayne Beavers; Patterson Intellectual Property Law, PC

(57) ABSTRACT

A texturing machine is provided for the subsequent treatment of a freshly produced concrete layer having a width between left and right edges and extending longitudinally in a working direction. Left and right height sensors are arranged to detect a height above the freshly produced concrete adjacent the left and right edges of the layer. At least one crown height sensor is arranged to detect a height above a crown of the freshly produced concrete layer. A controller is configured to receive input signals from the height sensors and to communicate height control sensors to the height adjustable columns and to communicate a crown control system to the crown actuator. A direction sensor may also detect at least one of the edges of the freshly produced concrete layer. The controller may receive a direction input signal from the direction sensor, and the controller may communicate a direction control signal to a steering actuator of one of the ground engaging units of the machine.

14 Claims, 11 Drawing Sheets

(56) References Cited

U.S. PATENT DOCUMENTS 3,779,662 A * 12/1973 Smith ..... B62D 55/116 404/98
3,849,017 A * 11/1974 Rochfort ..... E01C 19/4893 404/108
3,850,541 A * 11/1974 Baillet ..... E01C 19/407 404/114
3,874,806 A * 4/1975 Grist ..... E01C 19/43 404/93
4,526,493 A * 7/1985 Hall ..... E01C 19/43 404/104
4,744,694 A * 5/1988 Leone ..... E01C 23/025 404/89
4,978,246 A * 12/1990 Quenzi ..... E01C 19/006 172/4.5
5,352,063 A * 10/1994 Allen ..... E01C 19/008 404/102
5,507,591 A * 4/1996 Lyons ..... E01C 19/42 404/118
5,533,790 A * 7/1996 Weiland ..... B28D 1/18 299/1.5
5,556,226 A * 9/1996 Hohmann, Jr. ..... E01C 19/006 404/101
5,568,992 A * 10/1996 Grembowicz ..... E01C 19/48 404/101
5,742,069 A * 4/1998 Steenwyk ..... G01B 11/26 250/559.29
5,876,150 A * 3/1999 Koleszar ..... E01C 19/008 404/84.05
6,088,644 A * 7/2000 Brandt ..... E01C 19/004 172/4.5
6,287,048 B1 * 9/2001 Hollon ..... E01C 19/006 404/104
6,497,531 B2 * 12/2002 Sipherd ..... E01C 19/43 222/526
6,773,203 B2 * 8/2004 Casters ..... E01C 19/40 404/101
6,872,028 B2 * 3/2005 Aeschlimann ..... E01C 19/40 404/101
7,517,171 B2 * 4/2009 Coats ..... E01C 19/43 404/89
7,721,831 B2 5/2010 Smolders et al.
7,950,874 B2 * 5/2011 Guntert, Jr. ..... E01C 19/42 404/105
8,047,741 B2 11/2011 Von Schnebeck et al.
8,989,968 B2 * 3/2015 Fritz ..... E01C 19/42 701/50
9,010,310 B2 * 4/2015 Bockes ..... E01C 23/0933 125/12
9,127,418 B2 * 9/2015 Bockes ..... E01C 23/0966
9,399,842 B2 * 7/2016 Thieme ..... E01C 19/46
9,404,228 B1 * 8/2016 Coats ..... B62D 11/003
9,631,329 B2 * 4/2017 Fritz ..... E01C 19/42
2002/0119004 A1 8/2002 Sipherd et al.
2003/0175077 A1 * 9/2003 Godbersen ..... E01C 23/07 404/84.2
2006/0018715 A1 * 1/2006 Halonen ..... E01C 19/006 404/118
2007/0183847 A1 * 8/2007 Gordon ..... E02F 3/7609 404/96
2007/0183848 A1 8/2007 Fulton
2010/0150650 A1 * 6/2010 Buschmann ..... E01C 19/48 404/82
2011/0236129 A1 9/2011 Guntert, Jr. et al.
2012/0321385 A1 * 12/2012 Hanfland ..... G01B 21/08 404/84.1
2014/0186115 A1 * 7/2014 Graham ..... E01C 19/4873 404/75
2015/0050085 A1 * 2/2015 Bockes ..... E01C 23/0966 404/101
2016/0177517 A1 * 6/2016 Engels ..... G06T 7/20
2016/0177519 A1 * 6/2016 Fritz ..... E01C 19/42 404/84.5
2016/0305075 A1 * 10/2016 Thieme ..... E01C 19/008
2019/0054615 A1 * 2/2019 Ulliman ..... B24B 7/186
2020/0370250 A1 * 11/2020 Schlessel ..... E01C 19/43

OTHER PUBLICATIONS

Ex. B: "GOMACO Texturing/Curing Machines" Brochure, 8 pp., 2006.

European Search Report in corresponding European Patent Application No. EP 16 16 5463, dated Aug. 9, 2016, 6 pp. (not prior art).

* cited by examiner

CONCRETE TEXTURING MACHINE

BACKGROUND OF THE INVENTION

1. Field of the Invention

A texturing machine is provided for the subsequent treatment of a freshly produced concrete layer.

2. Description of the Prior Art

An example of a concrete texturing machine is generally shown in U.S. Pat. No. 7,721,831. Such texturing machines, also referred to as texturing and curing machines, can be used to texture a newly produced concrete pavement of a road surface by use of texturing devices, and to subsequently spray the concrete pavement with a liquid curing agent by means of a spraying assembly.

During the production of such a concrete surface, and particularly during the construction of concrete road surfaces, the concrete is generally paved to the required shape and position by a slipform paver, and is then smoothed by means of a smoothing device such as a transverse smoother. In some cases an additional longitudinal smoother is used.

Prior to the application of the curing agent by the texturing and curing machine, the newly formed concrete surface is typically given a finishing surface treatment with a texturing device providing a surface texture conforming to the intended use. It is thus intended to increase the skid resistance and riding comfort of the surface and to reduce the tire pavement noise.

SUMMARY OF THE INVENTION

In one embodiment a texturing machine is provided for the subsequent treatment of a freshly produced concrete layer having a width between left and right edges and extending longitudinally in a working direction. The texturing machine includes a machine frame, and at least one left side ground engaging unit and at least one right side ground engaging unit for supporting the machine frame from a ground surface. The texturing machine further includes at least one left side height adjustable column supporting the machine frame from the at least one left side ground engaging unit, and at least one right side height adjustable column supporting the machine frame from the at least one right side ground engaging unit. At least one texturing device is supported from the machine frame and configured to apply a texture into a not yet hardened surface of the concrete layer, the texturing device including an adjustable height crown point. At least one crown actuator is configured to adjust the height of the crown point. At least one crown height sensor is arranged to detect a height above the freshly produced concrete layer. A controller is configured to receive an input signal from the at least one crown height sensor and to communicate a crown control signal to the at least one crown actuator.

The machine may also include at least one left side height sensor arranged to detect a height above the freshly produced concrete layer and at least one right side height sensor arranged to detect a height above the freshly produced concrete layer. The controller may be configured to receive input signals from the left and right side height sensors and to communicate height control signals to the height adjustable columns.

At least one of the height sensors may be a contact sensor configured to contact a top surface of the freshly produced concrete layer.

At least one of the height sensors may be a contactless sensor.

At least one of the height sensors may comprise an array of contactless sensors. The array may extend transversely or longitudinally.

The array of contactless sensors and the controller may be configured such that an average input signal from the sensors of the array is used by the controller.

The array of contactless sensors and the controller may be configured to detect a position of one of the edges of the freshly produced concrete layer beneath the array.

The array of contactless sensors and the controller may be configured to eliminate an outlier input signal from one of the sensors of the array inconsistent with input signals from the other sensors of the array.

The texturing machine may further include at least one of the ground engaging units having a steering actuator configured to adjust the working direction of the machine. At least one direction sensor may be configured to detect at least one of the edges of the freshly produced concrete layer. The controller may be configured to receive a direction input signal from the at least one direction sensor, and to communicate a direction control signal to the steering actuator.

The at least one direction sensor may be a contact sensor configured to contact and follow the at least one of the edges of the freshly produced concrete layer.

The at least one direction sensor may be a contactless sensor.

The texturing machine may further include a curing device supported from the machine frame.

The machine frame may be articulated to define the crown point of the texturing device.

The texturing device may be a longitudinal texturing device extending transversely between the left and right ground engaging units, and the longitudinal texturing device may be articulated to define the crown point of the texturing device.

The texturing device may comprise a transverse texturing device including a track extending transversely between the left and right ground engaging units, and the track may be articulated to define the crown point of the transverse texturing device.

The texturing device may comprise a longitudinal texturing device extending transversely between the left and right ground engaging units.

The texturing device may comprise a transverse texturing device extending longitudinally and supported for transverse movement relative to the machine frame.

The machine may include at least one stringline sensor arranged to detect an external stringline located to at least one side of the freshly produced concrete layer, and the controller may be configured to receive an input signal from the at least one stringline sensor and to communicate height control signals to the height adjustable columns. The controller may also steer the texturing machine in response to the stringline sensor.

In another embodiment a method is provided for treating a freshly produced concrete layer having a width between first and second edges and extending longitudinally, the method comprising:

(a) driving a texturing machine longitudinally along the freshly produced concrete layer, the texturing machine including first and second ground engaging units on opposite sides of the freshly produced concrete layer, and a machine frame spanning the concrete layer and supported from the ground engaging units by first and second adjustable height support columns, the texturing machine including at least one texturing device supported from the machine frame and having an adjustable height crown point;

(b) sensing a height of the texturing machine relative to the concrete layer adjacent the crown point with a crown point height sensor generating an input signal;

(c) receiving the input signal in a controller and generating an output signal to control the height of the adjustable height crown point in response to the input signal; and (d) actuating an actuator in response to the output signal to adjust the height of the crown point.

The method may further comprise sensing a height of the texturing machine relative to the concrete layer adjacent each of the first and second edges with first and second edge height sensors, respectively, and generating first and second edge height input signals. The first and second edge height input signals may be received in the controller and the controller may generate first and second edge height control output signals in response to the first and second edge height input signals. The height of the first and second adjustable height support columns may be adjusted in response to the first and second edge height control output signals.

The method may further comprise:

detecting a position of at least one of the edges of the freshly produced concrete layer with an edge direction sensor and generating an edge direction input signal;

receiving the edge direction input signal in the controller and generating a direction control output signal in response to the edge direction input signal; and steering at least one of the ground engaging units with a steering actuator in response to the direction control output signal.

At least one of the sensors used in the method may be an array of contactless sensors.

An average signal from the sensors of the array may be used as the input signal generated by the array.

The method may discard an outlier signal from one of the sensors of the array.

The array of sensors may transversely span one of the edges of the concrete layer and the array may function as one of the edge height sensors and as the edge direction sensor used in the method.

The method may adjust the height of the crown point by changing an articulation angle of a machine frame which is articulated adjacent the crown point.

The method may adjust the height of the crown point by changing an articulation angle of an articulated longitudinal texturing device.

The method may adjust the height of the crown point by changing an articulation angle of an articulated track supporting a transverse texturing device.

The method may include longitudinally texturing the freshly produced concrete layer.

The method may include transversely texturing the freshly produced concrete layer.

The method may include detecting at least one external stringline located to at least one side of the freshly produced concrete layer with a stringline, and adjusting the height of at least one of the first and second adjustable eight support columns in response to the stringline sensor. The texturing machine may also be steered in response to the stringline sensor.

Numerous objects, features and advantages of the present invention will be readily apparent to those skilled in the art upon a reading of the following disclosure when taken in conjunction with the accompanying drawings.

BRIEF DESCRIPTION OF THE DRAWINGS

In FIG. 2 the concrete layer does not have a crown, and the articulated frame of the texturing machine is in an unarticulated position.

DETAILED DESCRIPTION

Figure 1:
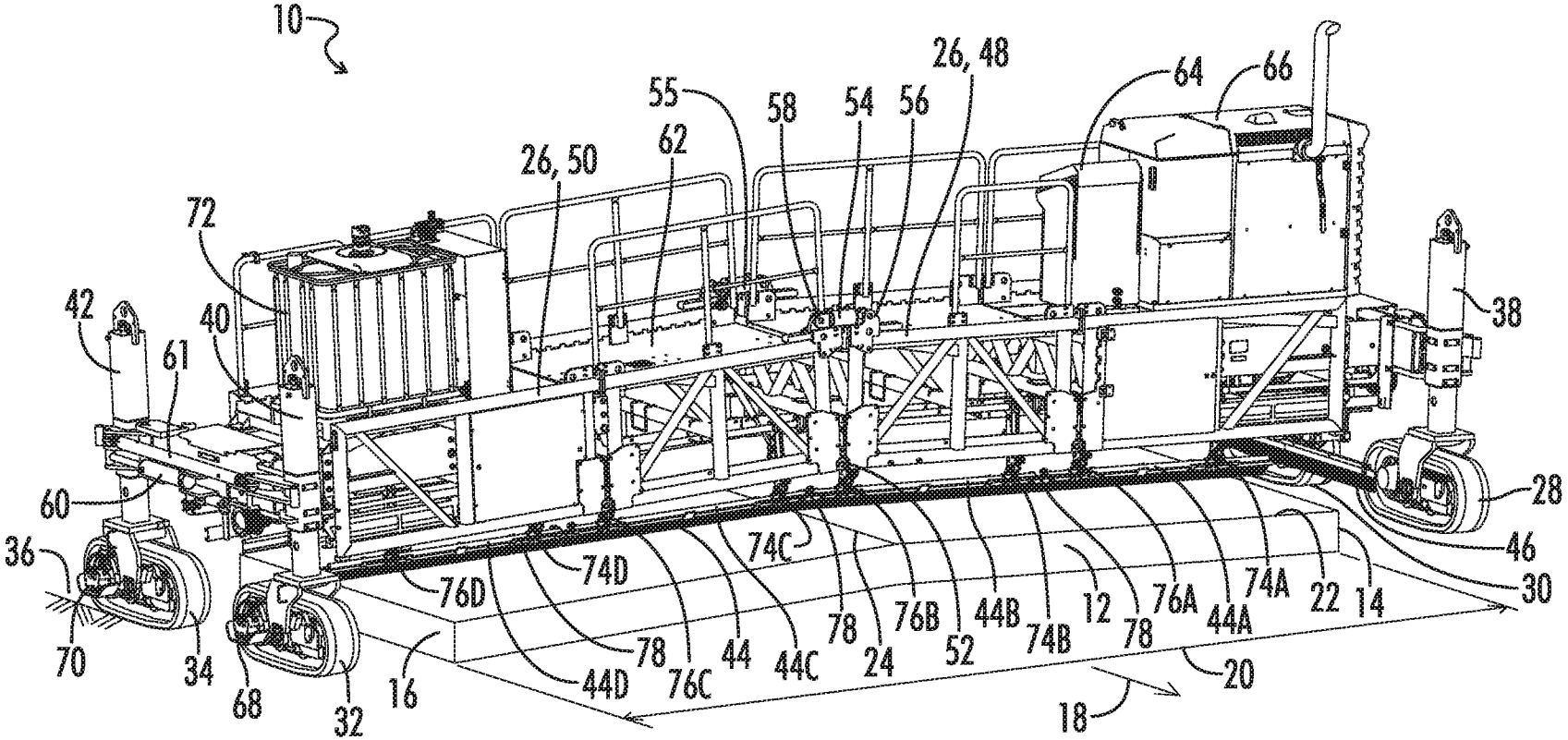
FIG. 1 is a front perspective view of a texturing machine showing a longitudinal texturing device engaged with the freshly produced concrete layer. The texturing machine includes an articulated frame which is articulated at a crown point to correspond to a crown of the concrete layer.

FIG. 1 shows a texturing machine, sometimes also referred to as a texturing and curing machine, generally designated by the numeral 10. Shown beneath the texturing machine 10 is a freshly produced concrete layer or slab 12 having a left edge 14 and a right edge 16 with reference to a working direction 18 of the texturing machine 10. The concrete layer includes a width 20 between the left and right edges, and extends longitudinally in the working direction 18. The freshly produced concrete layer 12 will have been produced by a slipform paving machine (not shown) advancing in front of the texturing machine. The concrete layer 12 has an upper surface 22, and in the embodiment shown in FIG. 1, the concrete layer 12 has a crown 24 and the surface of the concrete layer slopes downward from the crown 24 toward the left and right edges 14 and 16.

The texturing machine 10 includes a machine frame 26. Front and rear left side ground engaging units 28 and 30, and front and rear right side ground engaging units 32 and 34 are provided for supporting the machine frame 26 from a ground surface 36.

Each of the ground engaging units is associated with a height adjustable column supporting the machine frame 26 from its respective ground engaging unit. Left front height adjustable column 38, left rear height adjustable column 39, right front height adjustable column 40 and right rear height adjustable column 42 are provided.

A longitudinal texturing device 44 is shown in engagement with the surface 22 of the concrete layer 12. The longitudinal texturing device 44 includes a plurality of brushes extending downward and engaged with the surface 22, which brushes form shallow longitudinally extending grooves in the surface 22 as the texturing machine 10 moves in the working direction 18. Instead of brushes the texturing device may include bristles, a comb, a jute fabric, or any other suitable device for creating a texture in the freshly paved surface. As is seen in FIG. 1, the longitudinal texturing device 44 extends transversely between the ground engaging units on the left and right side of the machine 10.

Also seen in FIG. 1, but located out of engagement with the concrete slab 12, is a longitudinally extending transverse texturing device 46. As is further described below, the transverse texturing device is supported from the machine frame 26 for transverse movement relative to the machine frame 26.

The machine frame 26 is an articulated machine frame including left and right side frame portions 48 and 50 pivotally connected together at an articulation point 52. The articulation of the machine frame 26 at articulation point 52 allows the inclination and the crown height of the machine frame, and thus of the texturing devices supported therefrom, relative to the concrete layer 12 to be adjusted. A front crown actuator 54 which may be a hydraulic ram or other suitable actuator, is connected at pivot points 56 and 58 to the left and right sides 48 and 50, respectively, of machine frame 26. A rear crown actuator 55 is similarly connected. To raise the crown height of machine frame 26 from the position shown in FIG. 1, the crown actuators 54 and 55 would be further extended, and to reduce the crown height of machine frame 26 from the position shown in FIG. 1, the crown actuators would be retracted.

Each of the ground engaging units 28, 30, 32 and 34 is illustrated in FIG. 1 as being a track unit. Wheels could also be used for the ground engaging units.

At least one of the ground engaging units may include a steering actuator 60 configured to pivot the ground engaging unit about a vertical axis so as to steer the texturing machine 10 to adjust the working direction 18. A steering link 61 may connect the right rear and right front tracks 34 and 32 so they are both steered together by steering actuator 60. A similar steering mechanism is provided on the left side of the machine.

A working platform 62 is arranged on an upper part of the machine frame 26, and a control station 64 for a human operator may be located on the working platform 62.

An engine module 66 may be supported on the machine frame 26 for providing power to the machine 10. The engine module 66 may include a diesel engine or other prime mover driving a series of hydraulic pumps (not shown) for providing power to the various hydraulic equipment on the machine 10. Each of the ground engaging units 28, 30, 32 and 34 may be driven by a hydraulic motor such as 68 or 70 driving the tracks of the ground engaging units. Hydraulic power may also be provided from the engine module 66 to the various hydraulic actuators such as the height adjustable columns 38, 39, 40 and 42, the crown actuators 54 and 55, and the steering actuator 60.

Figure 6:
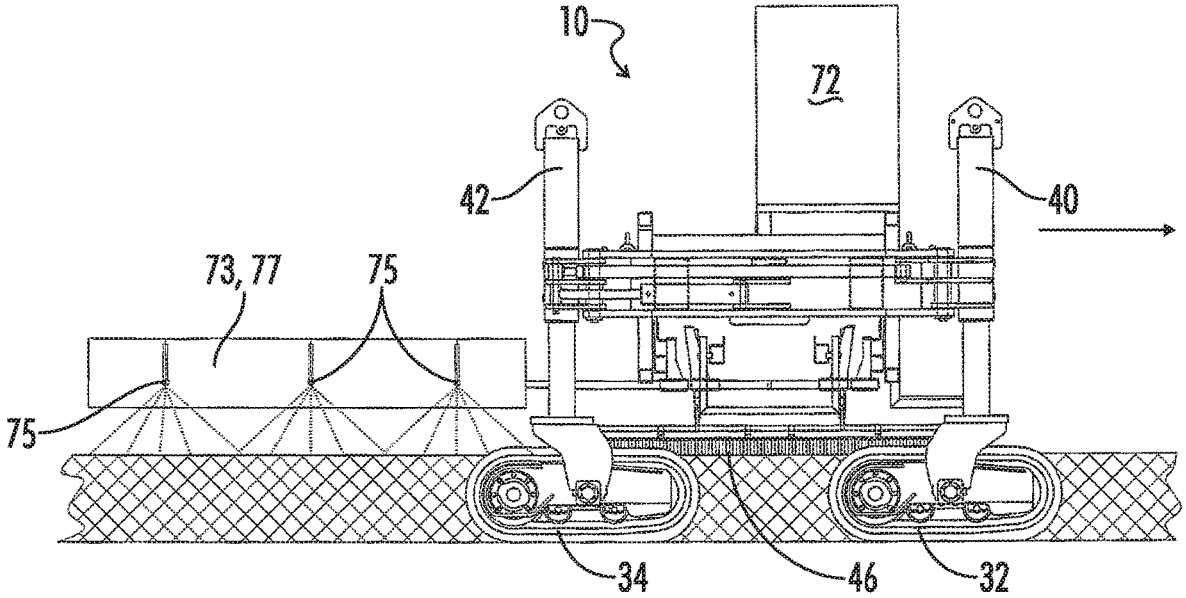
FIG. 6 is a right side elevation view of the texturing machine of FIG. 1.

A curing agent tank 72 may be carried by the machine frame 26 for holding a liquid curing agent to be sprayed on the concrete slab 12. FIG. 6 shows a right side elevation view of the texturing machine 10, where a curing device 73 is shown attached to the rear of the machine 10. The curing device 73 includes a plurality of curing agent spray heads 75 carried by a suitable framework 77.

As seen in FIG. 1, the longitudinal texturing device 44 may be made up of a plurality of transversely extending brush segments 44A, 44B, 44C and 44D connected together across the width of the machine. Segment 44A is supported from the left side 48 of machine frame 26 by vertical connectors 74A and 76A. Similarly brush segment 44B is supported from frame 26 by vertical connectors 74B and 76B. Adjacent segments of the longitudinal texturing device 44 are connected together by straps such as 78. The connection between segments 44B and 44C allows an articulation therebetween so the transversely extending longitudinal texturing device 44 can be articulated below the articulation point 52 of machine frame 26 thus forming a crown point in the longitudinal texturing device 44 and allowing the longitudinal texturing device 44 to have a transverse profile that can be adjusted to correspond to the transverse profile of the upper surface 22 of concrete layer 12.

Figure 2:
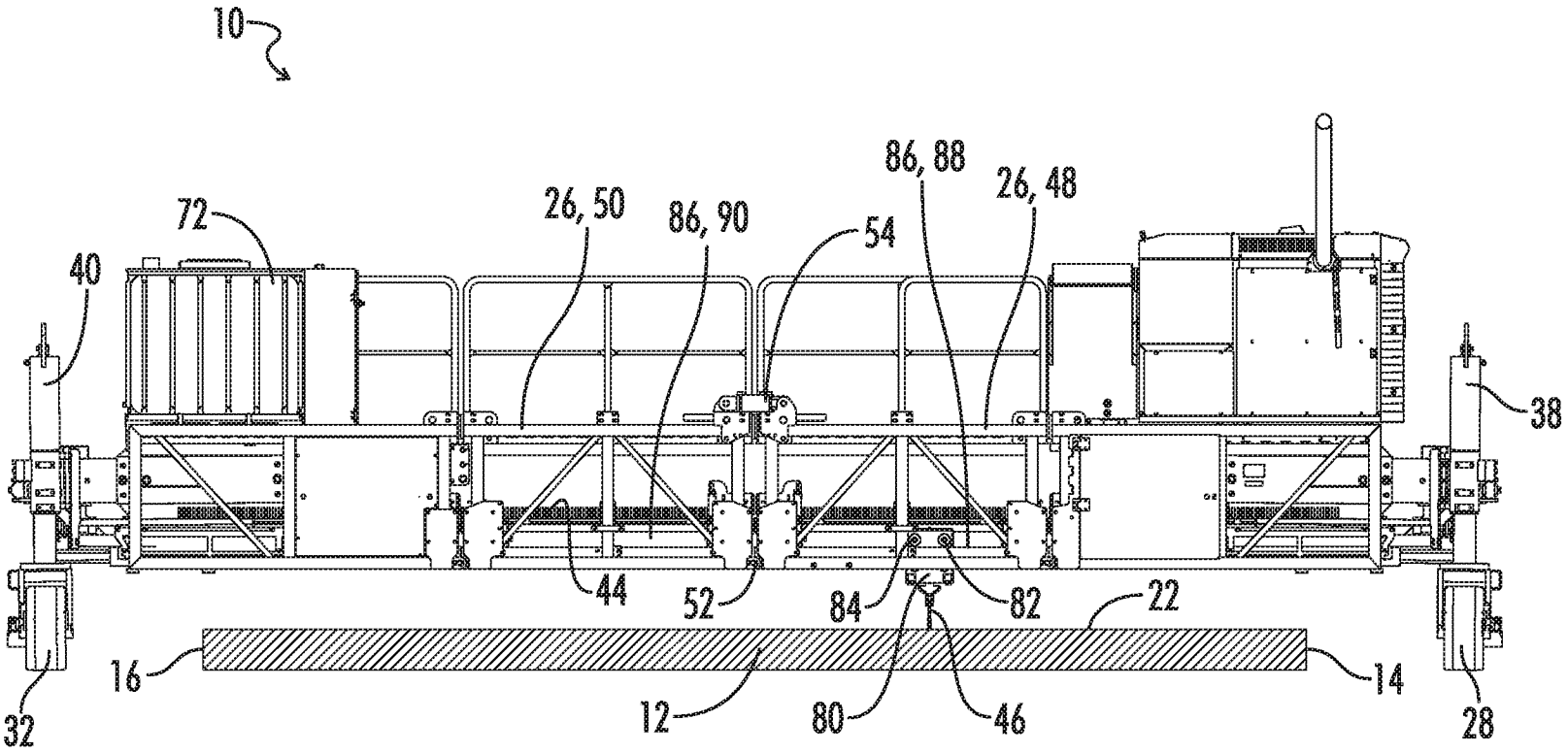
FIG. 2 is a front elevation view of the texturing machine of FIG. 1, showing a transverse texturing device engaged with the freshly produced concrete layer.

The transverse texturing device 46, as seen in FIG. 1, includes a longitudinally extending brush. As best seen in FIG. 2, the transverse texturing device 46 includes a carrier 80 including rollers 82 and 84 which roll along the top of a transversely extending track 86 attached to machine frame 26. The track 86 may include left and right track segments 88 and 90 which are connected together in an articulated manner above the articulation point 52 of machine frame 10. As seen in FIG. 2, the left and right track sections 88 and 90 extend substantially parallel to the left and right machine frame sections 48 and 50, so that when the machine frame 26 is articulated, the track 86 will be articulated in a similar manner. The carrier 80 which carries transverse texturing device 46 can follow the track 86 and thus follow the transverse profile of the machine frame 26. The transverse texturing device 46 may be described as including the track 86.

In FIG. 2, the machine frame 26 is shown having been adjusted to a zero crown height to correspond to a flat non-crowned top surface 22 of the concrete layer 12 shown in FIG. 2. It will be understood, however, that if the machine frame 26 is pivoted to create a non-zero crown height as shown in FIG. 1, the track sections 88 and 90 will similarly be pivoted relative to each other, so that as the transverse texturing device 46 follows the track 86 it will rise as it approaches the crown point of the machine frame and of the underlying concrete layer 12.

For the transverse texturing device 46 the adjustable height crown point thereof is defined by the articulation between the left and right track segments 88 and 90, which are attached to and articulate with the corresponding machine frame segments 48 and 50. As is further explained below regarding FIG. 11, the track segments can also be articulated and supported from a rigid non-articulated frame.

For the longitudinal texturing device 44, the adjustable crown point thereof is defined by the articulation between the brush segments 44B and 44C which are attached to and articulate with the corresponding articulated segments 48 and 50 of the machine frame 26. As is further explained below regarding FIG. 8, the brush segments can also be articulated and supported from a rigid non-articulated frame.

The transverse texturing device 46 may be moved transversely relative to the machine frame 26 along the track 86 by any suitable actuator system such as a system of cables and pulleys or the like. Thus as the texturing machine 10 slowly moves in the working direction 18, the transverse texturing device 46 may travel transversely across the width of the concrete layer 12 back and forth to apply shallow grooves extending substantially transversely to the working direction 18.

In the front elevation view of FIG. 2, the transverse texturing device 46 is shown in a position part way across the width of the concrete layer 12, and engaged with the top surface 22 of the concrete layer 12 to create a surface texture in the concrete layer 12 as the texturing device 46 moves transversely along the track 86. In FIG. 2, the longitudinal texturing device 44 has been moved to an upper storage position out of engagement with the concrete layer 12.

Figure 3:
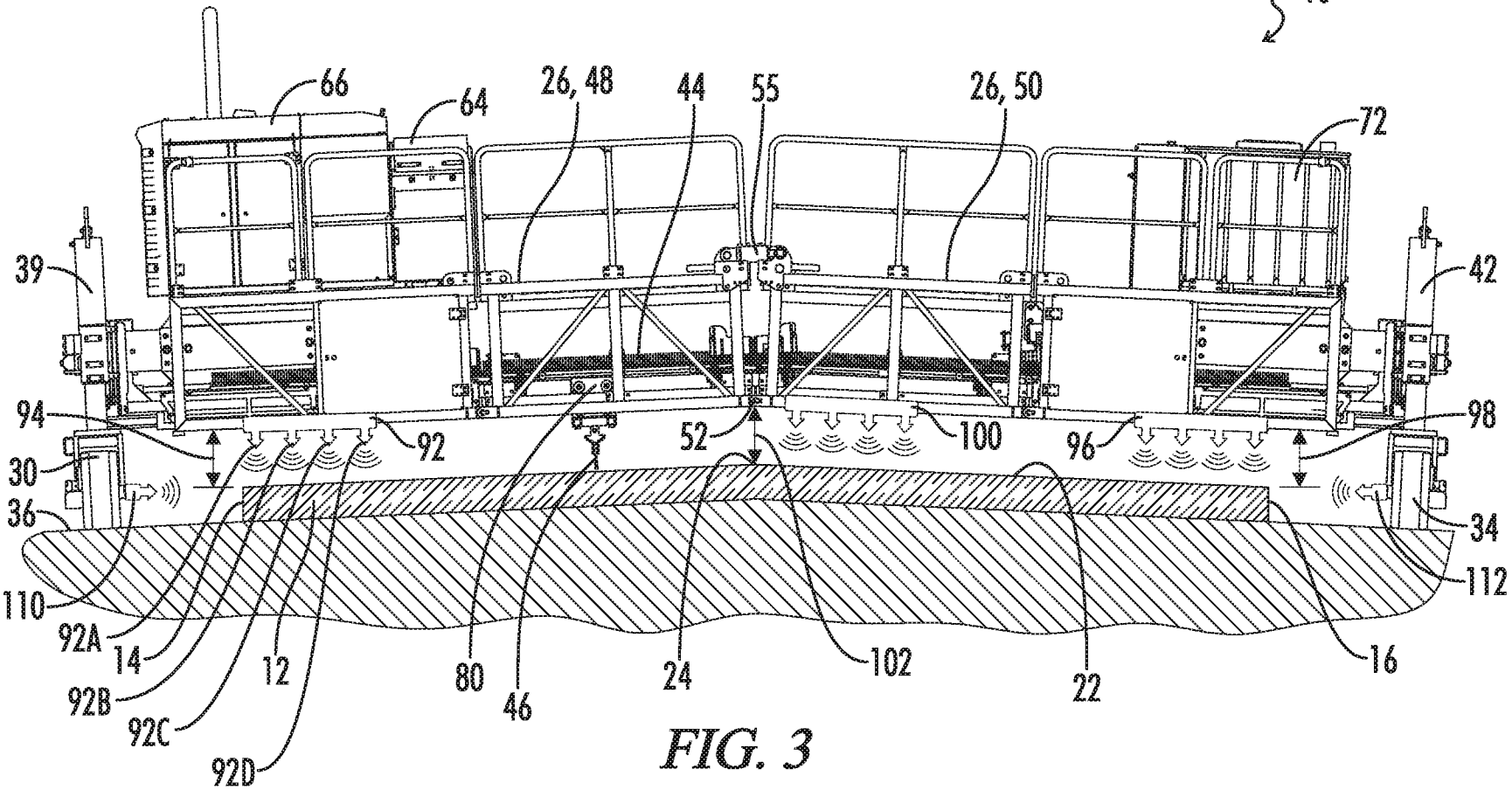
FIG. 3 is a rear elevation view of the texturing machine of FIG. 1, showing the articulated frame in an articulated position to correspond to the crown of the freshly produced concrete layer shown therebelow. One arrangement of contactless height sensors and edge sensors is illustrated. A transverse texturing device is shown engaging the surface of the concrete layer.

FIG. 3 shows a rear elevation view of the texturing machine 10. In FIG. 3 the concrete layer 12 is crowned having the crown 24. The machine frame 26 is in an articulated position. In FIG. 3 a first arrangement of sensors is shown for use in the control system of the texturing machine 10.

An array 92 of left side height sensors is arranged to detect a height 94 above the freshly produced concrete layer 12 adjacent the left edge 14 of the concrete layer 12. A right side height sensor array 96 is arranged to detect the height 98 above the surface 22 of the freshly produced concrete layer 12 adjacent the right hand edge 16 thereof. A crown height sensor array 100 is arranged to detect a height 102 relative to the crown 24 of concrete layer 12. Although the sensor arrays are oriented transversely in FIG. 3, any of those arrays can also be arranged longitudinally.

The sensors 92, 96 and 100 may be attached to the machine frame 26, or any portion thereof or structure attached thereto which articulates with the frame sections 48 and 50. In the alternative embodiments of FIGS. 8 and 11 using non-articulating frames, the sensors may be attached to the articulating portions of the texturing devices.

In FIG. 3 the heights detected by the sensors 92, 96 and 100 are schematically identified as the vertical dimensions from the surface 22 of slab 12 to the bottom of the machine frame 26, but it will be appreciated that any identifiable height at any location on the frame that is known relative to the positions of the longitudinal texturing device 44 or the transverse texturing device 46 may be utilized to control the frame height as further described below.

In the embodiment shown in FIG. 3, each of the sensor arrays such as left side sensor array 92 includes a plurality of contactless sensors such as 92A, 92B, 92C and 92D. The contactless sensors may for example be ultrasonic based sensors, infrared based sensors, laser based sensors, LED based sensors, CCD camera based sensors, or any other suitable contactless sensor system. As shown in FIG. 3, the left side height sensor array 92 includes an array of four contactless sensors spaced apart transversely, with the leftmost sensor 92A near the left side edge 14 of concrete layer 12.

Figure 7:
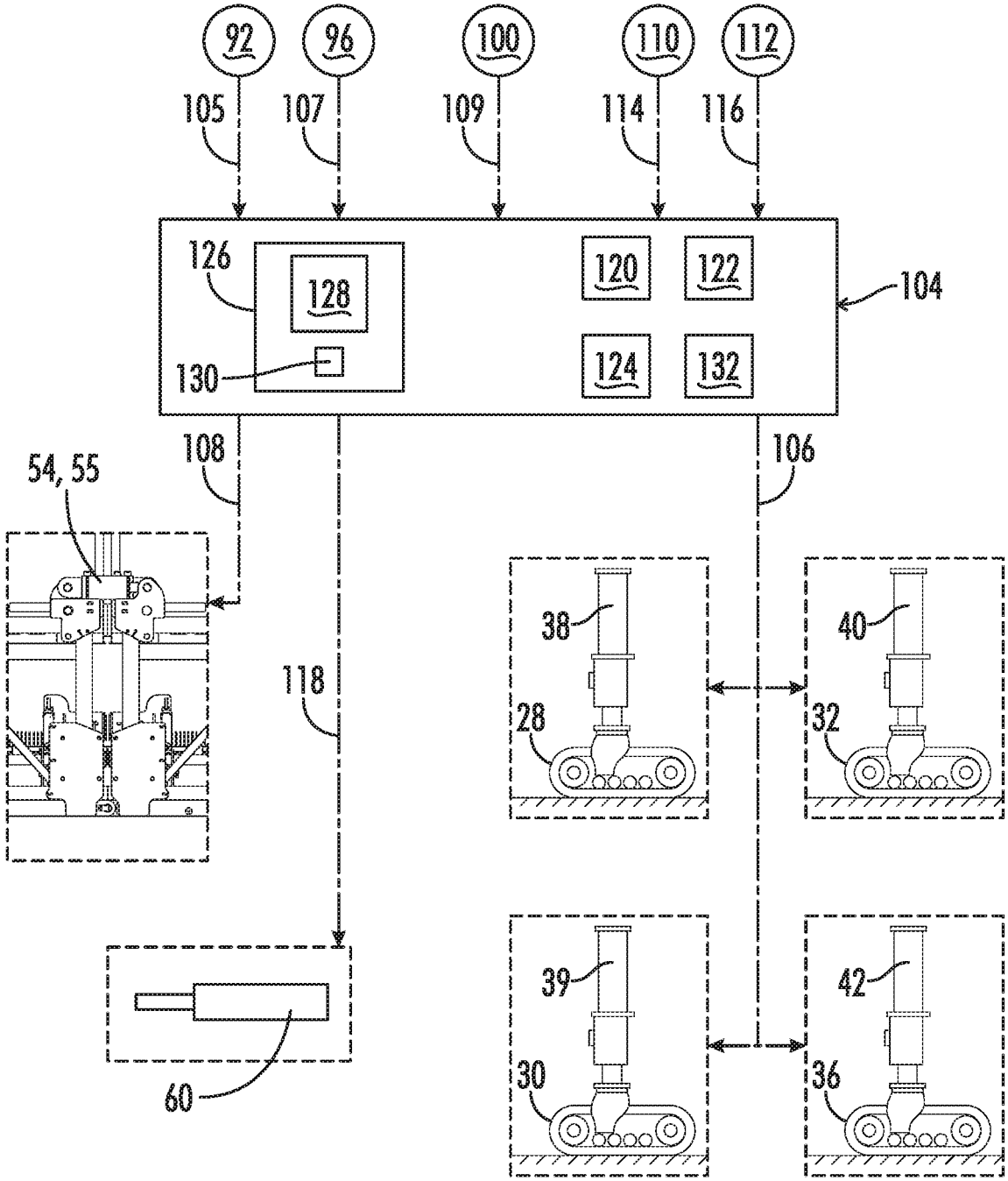
FIG. 7 is a schematic diagram of the control system of the texturing machine.

As schematically illustrated in FIG. 7, a controller 104 receives input signals from left side height sensor array 92, right side height sensor array 96, and crown height sensor array 100 over communication lines 105, 107 and 109, respectively.

In an embodiment, the controller 104 as described herein may refer to, or be embodied by, a computing system that includes a processor 120, a computer readable memory medium 122, a data base 124 and an input/output module or control panel 126 having a display 128. An input/output device 130, such as a keyboard or other user interface, is provided so that the human operator may input instructions to the controller. It is understood that the controller 104 described herein may be a single controller having all of the described functionality, or it may include multiple controllers wherein the described functionality is distributed among the multiple controllers.

The term "computer-readable memory medium" as used herein may refer to any non-transitory medium 122 alone or as one of a plurality of non-transitory memory media 122 within which is embodied a computer program product 132 that includes processor-executable software, instructions or program modules which upon execution may provide data or otherwise cause a computer system to implement subject matter or otherwise operate in a specific manner as further defined herein. It may further be understood that more than one type of memory media may be used in combination to conduct processor-executable software, instructions or program modules from a first memory medium upon which the software, instructions or program modules initially reside to a processor for execution.

"Memory media" as generally used herein may further include without limitation transmission media and/or storage media. "Storage media" may refer in an equivalent manner to volatile and non-volatile, removable and non-removable media, including at least dynamic memory, application specific integrated circuits (ASIC), chip memory devices, optical or magnetic disk memory devices, flash memory devices, or any other medium which may be used to stored data in a processor-accessible manner, and may unless otherwise stated either reside on a single computing platform or be distributed across a plurality of such platforms. "Transmission media" may include any tangible media effective to permit processor-executable software, instructions or program modules residing on the media to be read and executed by a processor, including without limitation wire, cable, fiber-optic and wireless media such as is known in the art.

In another embodiment, a controller 104 may not be or otherwise require a computing system, but may be separately embodied by, or otherwise independently configured within a machine, such as a general purpose processor, a digital signal processor (DSP), an application specific integrated circuit (ASIC), a field programmable gate array (FPGA) or other programmable logic device, discrete gate or transistor logic, discrete hardware components, or any combination thereof designed and programmed to perform or cause the performance of the functions described herein. A general purpose processor can be a microprocessor, but in the alternative, the processor can be a microcontroller, or state machine, combinations of the same, or the like. A processor can also be implemented as a combination of computing devices, e.g., a combination of a DSP and a microprocessor, a plurality of microprocessors, one or more microprocessors in conjunction with a DSP core, or any other such configuration.

Depending on the embodiment, certain acts, events, or functions of any of the algorithms described herein in accordance with a controller 104 can be performed in a different sequence, can be added, merged, or left out altogether (e.g., not all described acts or events are necessary for the practice of the algorithm). Moreover, in certain embodiments, acts or events can be performed concurrently, e.g., through multi-threaded processing, interrupt processing, or multiple processors or processor cores or on other parallel architectures, rather than sequentially.

For each of the texturing devices 44 and 46, a set point may be provided for the desired heights 94, 98 and 102 associated with each of the height sensors. The desired height set point may be varied to vary the degree of texturing between a lighter texture and heavier texture of the concrete surface.

The programming contained in the computer programming product 132 in the controller 104 is configured to compare input signals from the various height sensors to their respective set points and determine whether the left and right side height adjustable columns and/or the crown actuators should be adjusted so that the detected heights correspond to the desired set points. Thus the controller 104 will communicate height control signals to the height adjustable columns 38, 39, 40 and 42, and to the crown actuators 54 and 55 via control signal communication lines 106 and 108 schematically illustrated in FIG. 6.

It will be appreciated that the various height actuators 38, 39, 40 and 42 and the crown actuators 54 and 55 in the disclosed embodiment are hydraulic actuators which are actually powered by hydraulic fluid under pressure provided thereto. The flow of the hydraulic fluid under pressure will in turn be controlled by various electrically actuated solenoid valves associated therewith which in the schematic drawing of FIG. 7 may be considered to be a part of the identified actuators. Thus the control signal communication lines 106 and 108 may communicate electrical control signals to solenoid actuated valves associated with the various hydraulic actuators. Any other suitable arrangement may be utilized for communicating between the controller 104 and the various actuators.

FIG. 3 also illustrates left and right contactless direction sensors 110 and 112 supported from the machine 10 and configured to detect the left and right side edges 14 and 16, respectively, of the freshly produced concrete layer 12. The direction sensors 110 and 112 may be ultrasonic based sensors, infrared based sensors, laser based sensors, LED based sensors, CCD camera based sensors, or any other suitable contactless sensor system. The direction sensors are detecting a lateral distance to the edge 14 or 16, and thus will allow the texturing machine 10 to follow the edge 14 or 16 and thus control the direction of the texturing machine 10 to follow the path of the concrete layer 12. Although both left and right side direction sensors 110 and 112 are illustrated, it will be understood that typically only one direction sensor will be used to steer the paving machine.

The controller 104 receives the direction input signals from the left and/or right direction sensors 110 and 112 over communication lines 114 and 116 and correspondingly communicates a direction control signal to the steering actuator 60 via control signal communication line 118.

When using an array of sensors such as the sensors 92A-92D of sensor array 92, the array of sensors and the controller 104 may be configured such that an average input signal from the sensors of the array is used by the controller 104.

Furthermore, the array of sensors and the controller 104 may be configured to eliminate an outlier input signal from one of the sensors of the array inconsistent with input signals from the other sensors of the array. Thus, for example, if there is an obvious error in one of the sensors 92A-92D of the array 92 seen in FIG. 3 it will not adversely affect the output from the sensor array 92.

Figure 4:
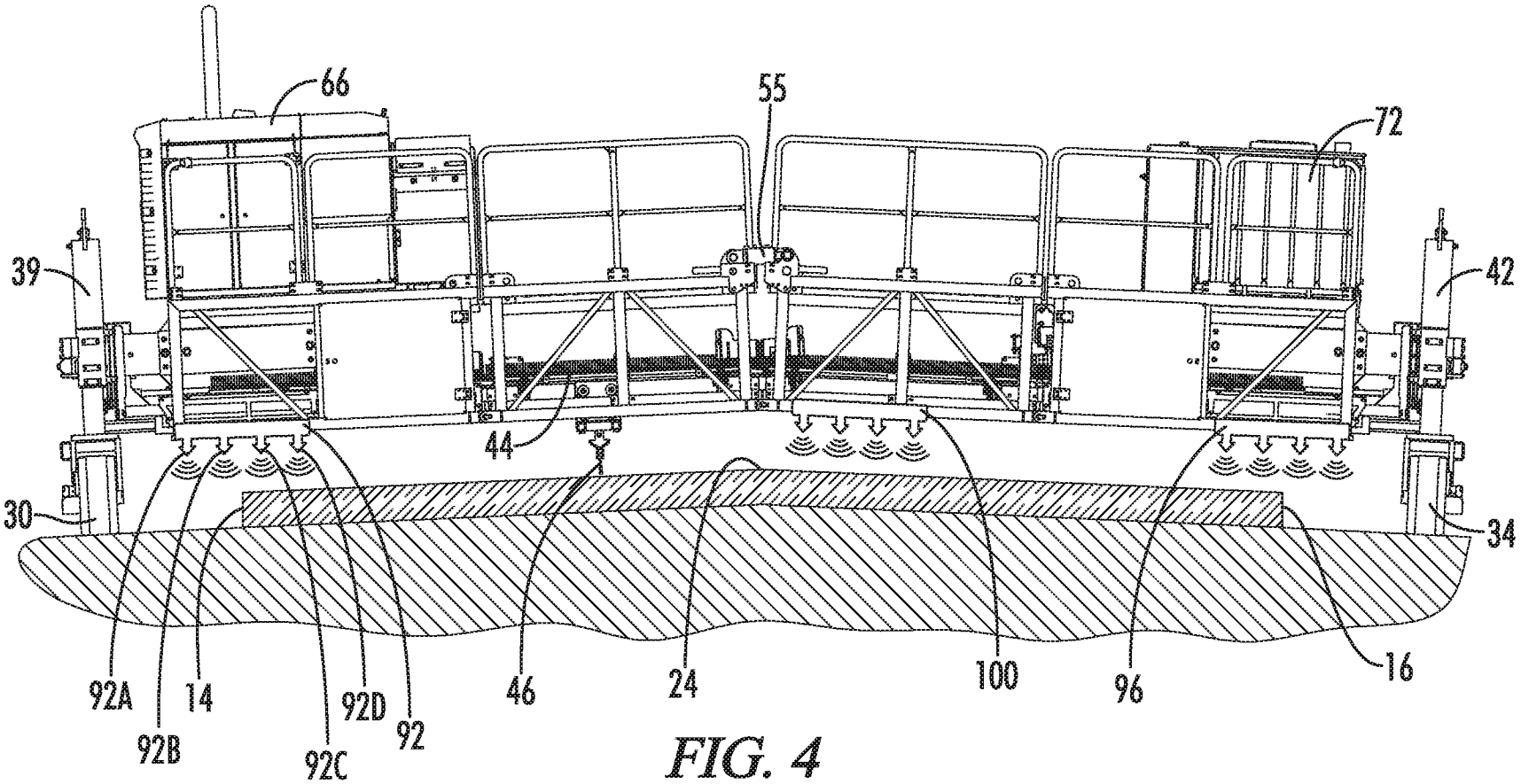
FIG. 4 is a rear elevation view similar to FIG. 3 illustrating a different arrangement of contactless sensors.

Referring now to FIG. 4, an alternative location is provided for the left and right sensor arrays 92 and 96 in which the arrays extend across the edges 14 and 16, respectively, of the concrete layer 12. With such an arrangement, the array 92 for example may be utilized to detect the position of the edge 14 as being between the transverse locations of sensors 92B and 92C of the array. It is noted that with the arrangement of FIG. 4 there is no need for the separate edge detection sensors 110 and 112.

Figure 5:
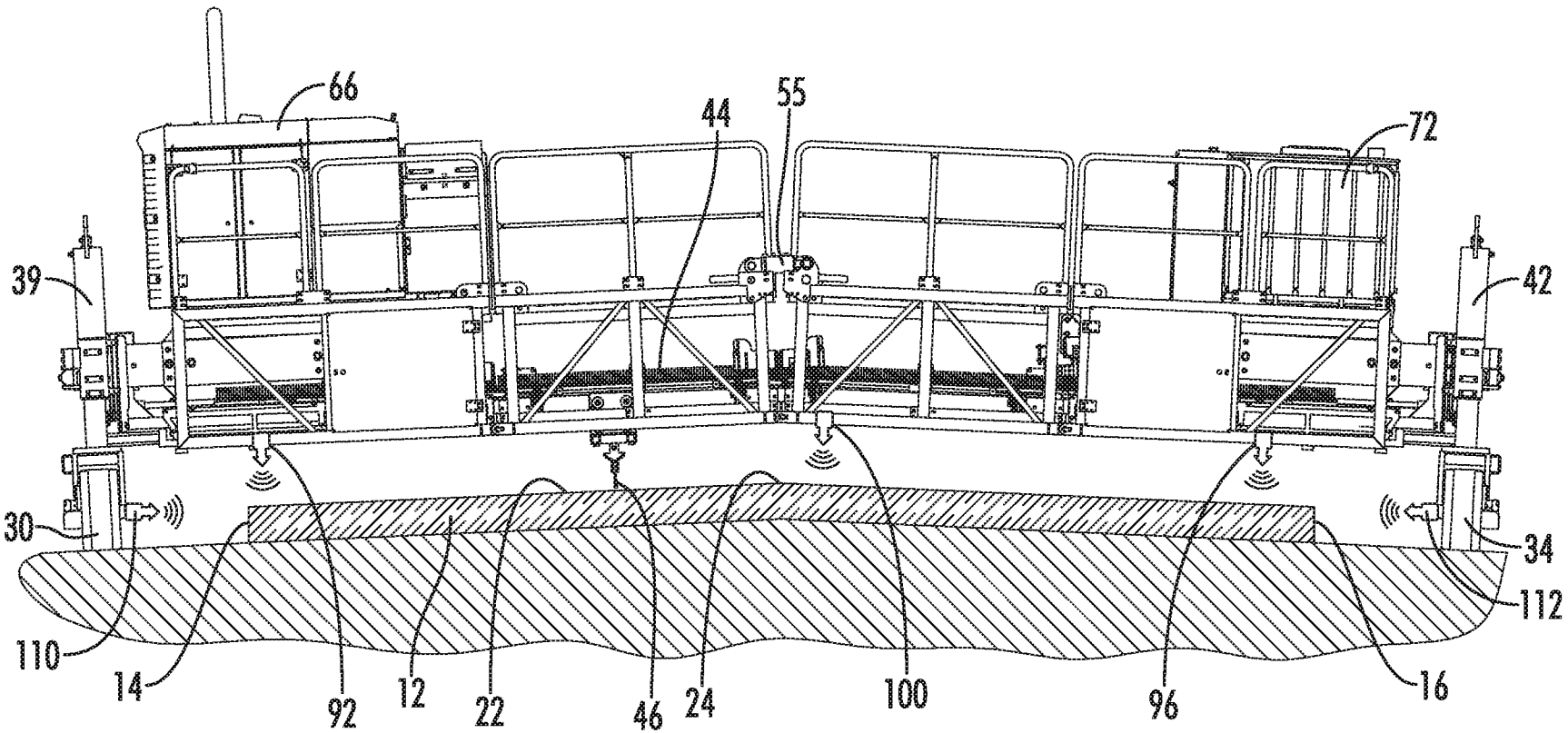
FIG. 5 is a rear elevation view similar to FIG. 3 showing yet another arrangement of contactless sensors.

And another alternative arrangement of sensors is shown in FIG. 5. In FIG. 5 the height sensors 92, 96 and 100 are single sensors rather than arrays.

Figure 9:
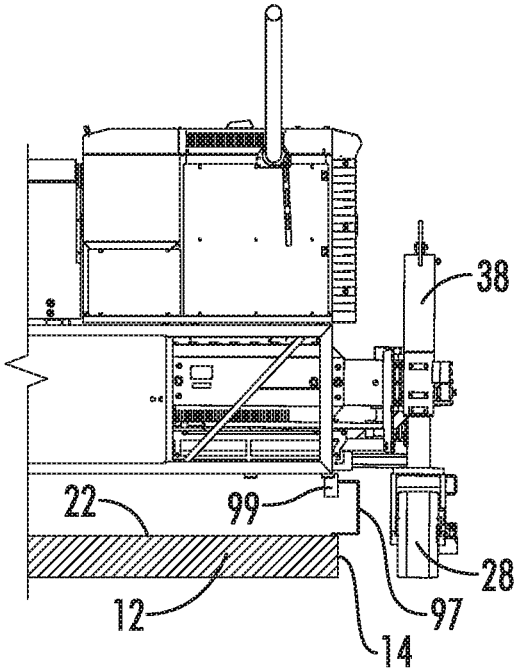
FIG. 9 is a schematic illustration of a contact type sensor for detecting a height above a surface of the concrete layer.

Although the height sensors 92, 96 and 100 illustrated in FIGS. 3, 4 and 5 are contactless sensors, a contact type sensor could also be utilized to contact the top surface 22 of the concrete layer 12. An example of a contact type sensor is schematically illustrated in front elevation view in FIG. 9 and shows a feeler 97 pivotally attached to a rotary sensor mechanism 99 supported from texturing machine 10. The feeler 97 may be spring biased into contact with the surface 22.

Figure 10:
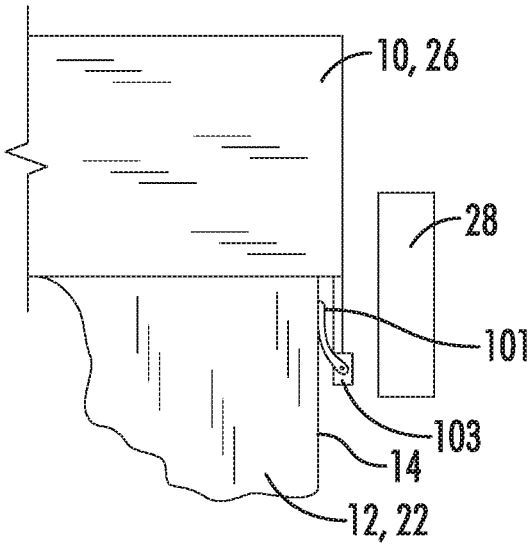
FIG. 10 is a schematic illustration of a contact type sensor for detecting a direction of an edge of the concrete layer.

And although the direction sensors 110 and 112 shown in FIGS. 3, 4 and 5 are contactless direction sensors, it is also possible to use a contact type direction sensor. A contact type direction sensor is schematically illustrated in plan view in FIG. 10 and includes a feeler 101 arranged to contact and follow the associated edge 14 of the concrete layer 12. The feeler 101 is pivotally attached to a rotary sensor mechanism 103 supported from the texturing machine 10. The feeler 101 may be spring biased into contact with the associated edge 14.

Figure 8:
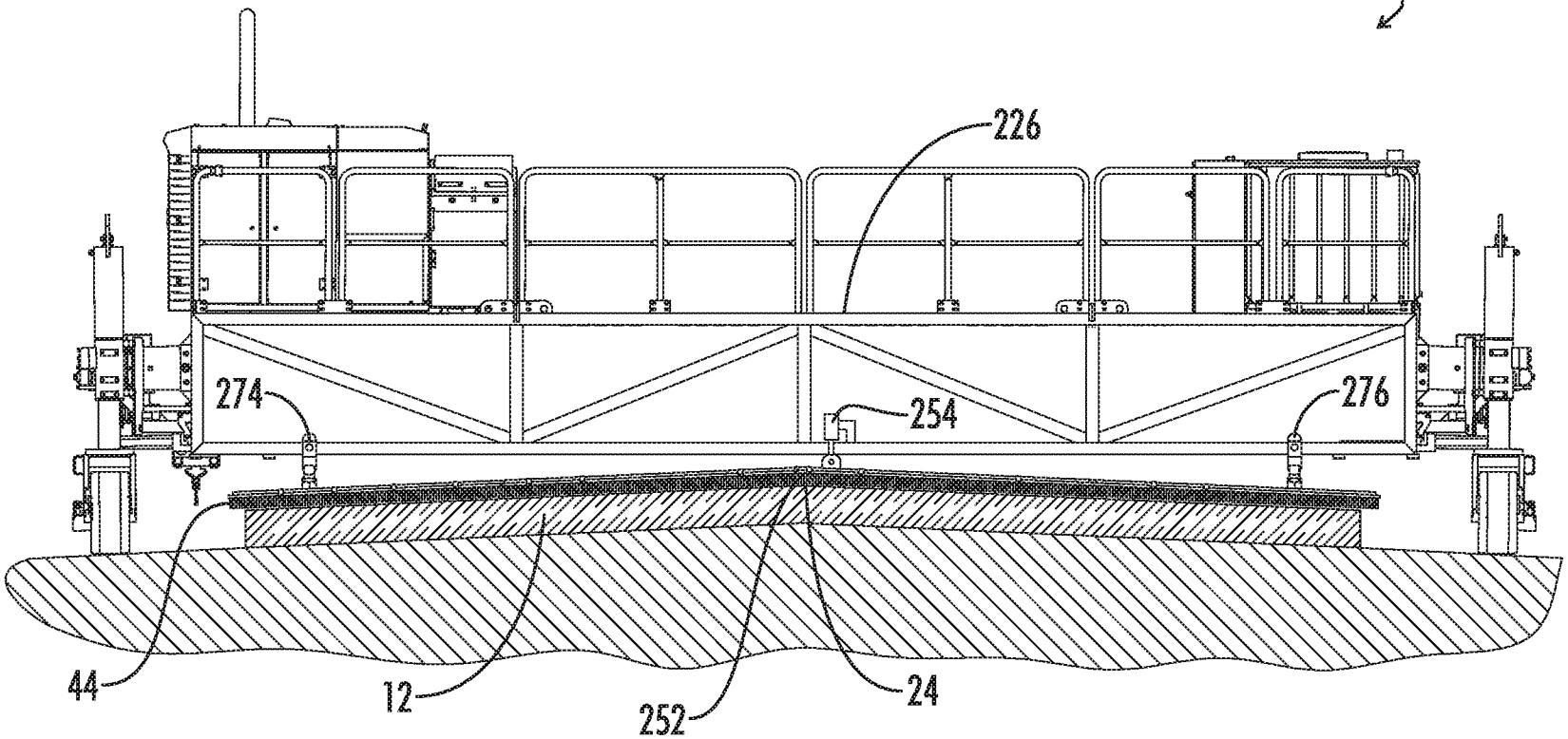
FIG. 8 is a schematic rear elevation view of an alternative texturing machine having a non-articulated frame and supporting a texturing device which is articulated to correspond to the crown of the concrete slab.
Figure 11:
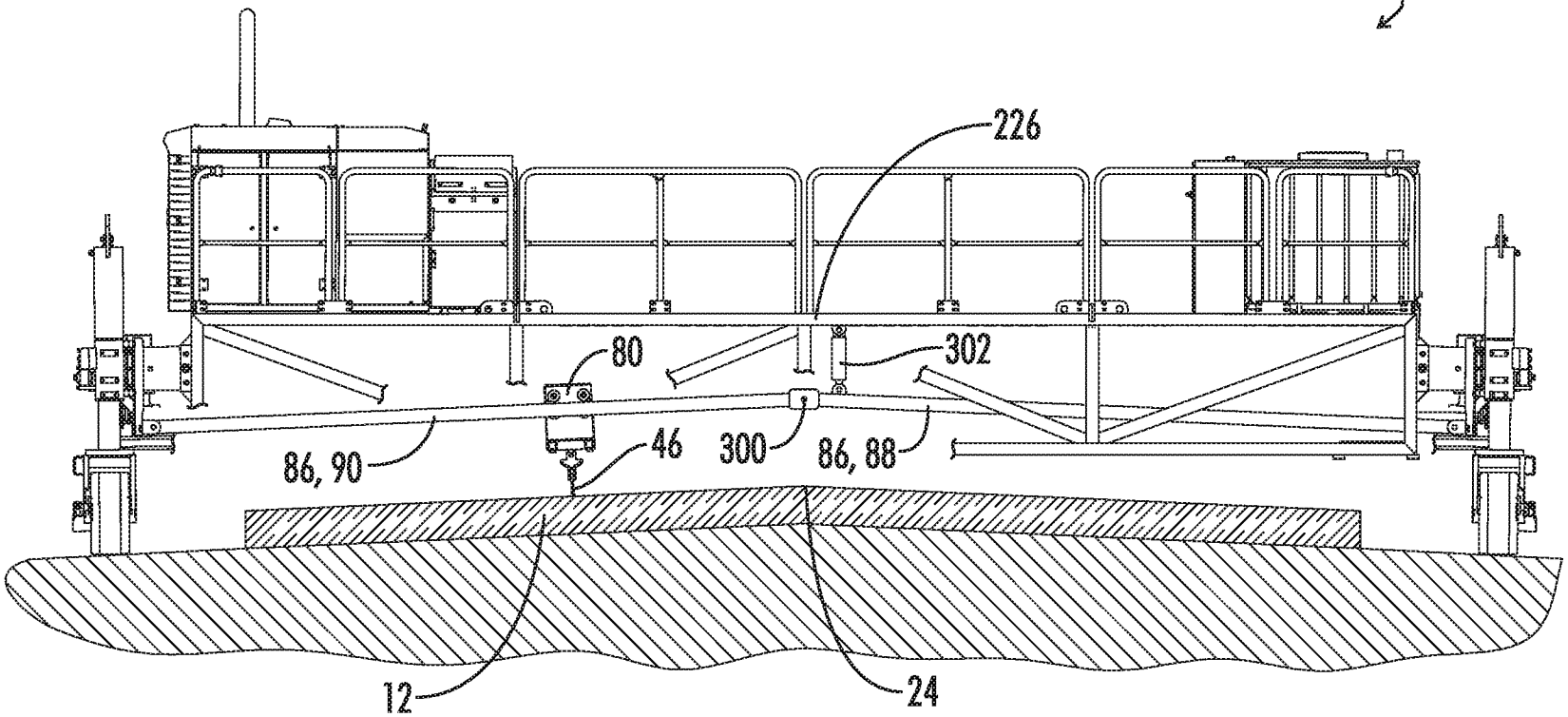
FIG. 11 is a schematic rear elevation view of an alternative texturing machine having a non-articulated frame and supporting a transverse texturing device including an articulated track which can be adjusted to correspond to the crown of the concrete slab.

Embodiments of FIGS. 8 and 11

Referring now to FIG. 8 a schematic drawing is there shown of an alternative texturing machine 210 having a rigid non-articulated frame 226 and supporting a longitudinal texturing device 44 which is articulated at 252 to correspond to the crown 24 of the concrete layer 12.

The longitudinal texturing device 44 is pivotally supported from frame 226 near each end at pivotal supports 274 and 276. Near the articulation 252 one side of the longitudinal texturing device 44 is attached to a vertical actuator 254, which may be a hydraulic ram, capable of lifting or lowering the longitudinal texturing device to adjust the crown point of the texturing device.

Referring to FIG. 11 a schematic drawing is there shown of the transverse texturing device 46 as used with the texturing machine 210 having the non-articulated frame 226. Portions of the frame 226 are cut-away for ease of viewing of the texturing device. The transverse texturing device 46 travels on the articulated track 86. Track sections 88 and 90 have an articulation point 300 therebetween. A crown height actuator 302 is schematically shown and supports the articulated track 86 from the frame 226. The actuator 302 retracts to increase the crown height and extends to decrease the crown height.

Figure 12:
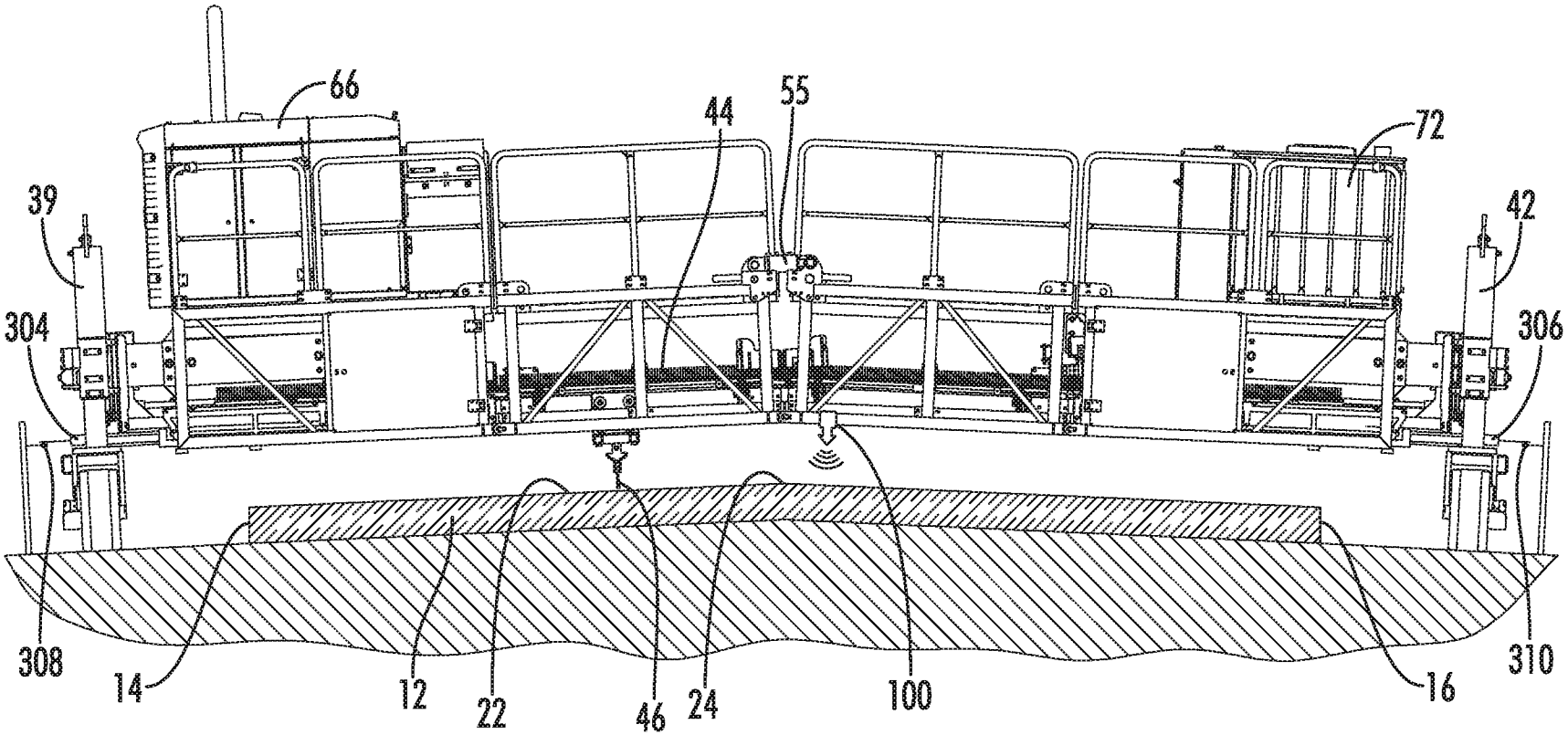
FIG. 12 is a schematic rear elevation view of an alternative texturing machine using stringline sensors on each side of the machine.

Embodiment of FIG. 12

FIG. 12 illustrates a modification of the texturing machine 10, similar to FIG. 5, in which side height sensors and direction sensors are eliminated. The texturing machine of FIG. 12 utilizes standard stringline sensors 304 and 306 on each side to detect the locations of stringlines 308 and 310 which have been erected on the ground surface.

The machine of FIG. 12 may utilize the same stringlines 308 and 310 used by the slipform paving machine that constructed the freshly produced concrete layer 12. Those stringlines can provide both height and directional references which are used to guide the texturing machine 10.

Methods of Operation

In a method of operation of the texturing machine 10, the texturing machine 10 will follow closely behind a slipform paving machine (not shown) which has formed the freshly produced concrete layer 12.

The texturing machine 10 may be driven longitudinally along the freshly produced concrete layer 12 in the paving direction 18. While the texturing machine 10 may follow the slipform paving machine in a continuous manner, it will be understood that the texturing machine 10 may also stop and start, and may actually back up so as to process certain stretches of the freshly produced concrete layer more than once. The texturing machine 10 may also texture the surface 22 of the concrete layer 12 when the texturing machine is backing up or moving opposite to the paving direction 18.

The texturing machine 10 will have its left and right ground engaging units located on opposite sides of the freshly produced concrete layer 12 and the machine frame 26 will span the concrete layer 12 and be supported from the ground engaging units by the associated height adjustable support columns such as 38, 39, 40 and 42. The texturing machine 10 includes its texturing device 44 and/or 46 supported from the articulated machine frame 26 and thus has an adjustable height crown point above the crown 24 of the concrete layer 12.

A height of the texturing machine or some portion thereof relative to the concrete layer 12 above or closely adjacent the crown 24 of the concrete layer 12 is sensed with the crown point height sensor 100 thus generating an input signal conveyed over communication line 109 to controller 104.

The input signal from line 109 is received in the controller 104, and the controller 104 generates an output signal which is communicated over line 108 to actuate the crown point adjusters 54 and 55 to adjust the height of the adjustable height crown point in response to the input signal.

Additionally, a height of the texturing machine 10 or some portion thereof relative to the concrete layer 12 adjacent each of the first and second edges 14 and 16 may be detected with the first and second edge height sensors 92 and 96, respectively, thereby generating first and second edge height input signals which are communicated over communication lines 105 and 107 to the controller 104.

The first and second edge height input signals are received from communication lines 105 and 107 in the controller 104, and the controller 104 generates first and second edge height control output signals in response to the first and second edge height input signals.

The height of the various height adjustable columns 38, 39, 40 and 42 may be adjusted in response to the first and second edge height control output signals received over communication line 106.

Additionally, a position of one or both of the edges 14 and 16 of the freshly produced concrete layer 12 may be detected with edge direction sensors such as direction sensors 110 and 112, respectively. Alternatively, sensor arrays spanning across the edges, such as illustrated in FIG. 4, may be utilized as the edge direction sensors.

Edge direction input signals are received in the controller 104 over communication lines such as 114 and 116, and the controller 104 may generate a direction control output signal in response to the edge direction input signal or signals.

A steering actuator 60 of one or more of the ground engaging units may be steered in response to the direction control output signal received over communication line 118.

Optionally the texturing machine may use stringlines 308 and 310, as seen in FIG. 12, as references for controlling the side heights of the machine 10 and for steering the machine 10.

As the texturing machine moves along the length of the concrete layer 12, the machine frame may be articulated to adjust the height of the crown point of the machine 10 relative to the crown 24 of the concrete layer 12. Thus the crown point height may be adjusted as the crown 24 of the concrete layer varies so as to maintain a desired height of the texturing devices above the concrete layer.

With the embodiments of FIGS. 8 and 11, the texturing device itself may be articulated and may be carried by a rigid non-articulating frame.

The concrete layer may be textured longitudinally by the longitudinal texturing device 44, and/or transversely by the transverse texturing device 46.

Thus it is seen that the objects of the present invention are readily achieved by the apparatus and methods disclosed herein. While certain preferred embodiments have been illustrated and described for purposes of the present disclosure, numerous changes in the arrangement and construction of parts and steps may be made by those skilled in the art which changes are encompassed within the scope and spirit of the appended claims.

What is claimed is:

1. A method of treating a freshly produced concrete layer produced by a slipform paving machine, the freshly produced concrete layer having a width between first and second edges and extending longitudinally, the method comprising:

(a) driving a texturing machine separate from and behind the slipform paving machine and longitudinally along the freshly produced concrete layer and texturing the freshly produced concrete layer, the texturing machine including first and second ground engaging units on opposite sides of the freshly produced concrete layer, and a machine frame spanning the concrete layer and supported from the ground engaging units by first and second adjustable height support columns, the texturing machine including at least one texturing device supported from the machine frame and having an adjustable height crown point provided by an articulation of at least one of the machine frame and the texturing device;

(b) sensing a height of the texturing machine relative to the concrete layer adjacent the crown point with a crown point height sensor generating an input signal;

(c) receiving the input signal in a controller and generating an output signal to control the height of the adjustable height crown point in response to the input signal;

(d) actuating an actuator in response to the output signal and thereby articulating the at least one of the machine frame and the texturing device to adjust the height of the crown point during the texturing of step (a);

(e) sensing a height of the texturing machine relative to the concrete layer adjacent each of the first and second edges with first and second edge height sensors, respectively, and generating first and second edge height input signals;

(f) receiving the first and second edge height input signals in the controller and generating first and second edge height control output signals in response to the first and second edge height input signals; and (g) adjusting the height of the first and second adjustable height support columns to adjust a height of the machine frame relative to the concrete layer and thereby adjusting a height of the at least one texturing device relative to the concrete layer in response to the first and second edge height control output signals during the texturing of step (a).

2. The method of claim 1, further comprising:

detecting a position of at least one of the edges of the freshly produced concrete layer with an edge direction sensor and generating an edge direction input signal;

receiving the edge direction input signal in the controller and generating a direction control output signal in response to the edge direction input signal; and steering at least one of the ground engaging units with a steering actuator in response to the direction control output signal.

3. The method of claim 2, wherein:

at least one of the sensors is a contact sensor.

4. The method of claim 2, wherein:

at least one of the sensors is a contactless sensor.

5. The method of claim 2, wherein:

at least one of the sensors comprises an array of contactless sensors.

6. The method of claim 5, further comprising:

using an average signal from the sensors of the array as the input signal generated by the array.

7. The method of claim 5, further comprising:

discarding an outlier signal from one of the sensors of the array.

8. The method of claim 5, wherein:

the array of sensors transversely spans one of the edges of the concrete layer and the array functions as one of the edge height sensors and the edge direction sensor.

9. The method of claim 1, wherein:

in step (d) the machine frame is articulated adjacent the crown point, and the height of the crown point is adjusted by adjusting an articulation angle of the machine frame.

10. The method of claim 1, wherein:

in step (d) the texturing device comprises an articulated longitudinal texturing device extending transversely between the left and right ground engaging units, and the actuator adjusts the articulation of the longitudinal texturing device to adjust the height of the crown point of the longitudinal texturing device.

11. The method of claim 1, wherein:

in step (d) the texturing device comprises a transverse texturing device including an articulated track extending transversely between the left and right ground engaging units, and the actuator adjusts the articulation of the track to adjust the height of the crown point of the transverse texturing device.

12. The method of claim 1, wherein:

the texturing of step (a) includes longitudinally texturing the freshly produced concrete layer.

13. The method of claim 1, wherein:

the texturing of step (a) includes transversely texturing the freshly produced concrete layer.

14. The method of claim 1, further comprising:

detecting at least one external stringline located to at least one side of the freshly produced concrete layer with a stringline sensor; and steering at least one of the ground engaging units with a steering actuator in response to the stringline sensor.

* * * * *